United States Patent [19]

Tsuji et al.

[11] 4,227,166

[45] Oct. 7, 1980

[54] REACTOR

[75] Inventors: Toshihiko Tsuji; Riyouji Sakai, both of Tokyo, Japan

[73] Assignee: Nippon Kinzoku Co., Ltd., Tokyo, Japan

[21] Appl. No.: 913,193

[22] Filed: Jun. 6, 1978

[30] Foreign Application Priority Data

Jun. 8, 1977 [JP] Japan ..... 52/67650

[51] Int. Cl.[2] ..... H01F 27/24

[52] U.S. Cl. ..... 336/229; 75/0.5 AA; 148/104; 252/62.54; 252/62.55; 336/233

[58] Field of Search ..... 336/229, 233, DIG. 3, 336/DIG. 4, 221; 148/104, 105, 31.55, 31.57; 75/0.5 AA; 252/62.51 R, 62.53, 62.54, 62.55

[56] References Cited

U.S. PATENT DOCUMENTS

| | | | |
|---|---|---|---|
| 1,292,206 | 1/1919 | Woodruff | 336/233 X |
| 1,297,126 | 3/1919 | Elmen | 336/233 X |
| 1,297,127 | 3/1919 | Elmen | 336/233 X |
| 1,809,042 | 6/1931 | Kelsau | 336/233 X |
| 1,982,689 | 12/1934 | Polydoroff | 252/62.53 X |
| 2,241,441 | 5/1941 | Bandur | 336/233 X |
| 2,816,053 | 12/1957 | Berge | 148/31.55 |
| 2,844,456 | 7/1958 | Llewelyn | 75/0.5 AA |
| 2,978,323 | 4/1961 | Schmeckenbecher | 252/62.51 X |
| 3,615,339 | 10/1971 | Stone | 75/0.5 AA |
| 3,694,187 | 9/1972 | Llewelyn | 75/0.5 AA |
| 3,694,188 | 9/1972 | Llewelyn | 75/0.5 AA |
| 3,953,251 | 4/1976 | Butherus et al. | 148/105 |

*Primary Examiner*—Thomas J. Kozma

[57] ABSTRACT

A reactor comprising an annular iron core constituting a closed magnetic path and a conductor wound on the iron core. The iron core is formed of particles of iron or an iron-based magnetic material. Each particle is covered with an insulative oxide film which contains 0.3 to 0.8% of oxygen by weight based on the particle.

5 Claims, 6 Drawing Figures

REACTOR

BACKGROUND OF THE INVENTION

This invention relates to a reactor having a core formed of particles of iron or an iron-based magnetic material.

Recently a reactor having a constant inductance over a wide frequency range is widely used for various purposes. For instance, it is used to eliminate high frequency noises, to reverse current flow in inverter circuits using transistors, to protect electronic elements and to filter waves. Further it is employed as a transducer for thyristors.

The core of such a conventional reactor is made of, for example, ferrite, silicon steel plate or the like. Air gaps are arbitrarily provided on the magnetic flux path of the core, and the magnetic resistance in the air gaps determines the inductance of the reactor.

One of the known reactor is constructed as shown in FIG. 1. Its iron core 1 is made of ferrite, silicon steel plate or the like and has a cross section in the form of letter "I". A conductor is wound around the iron core 1 to form a coil 2. When the coil 2 is energized, a magnetic flux $\phi$ flows from the center of the iron core 1, through an upper flange of the core 1, through the air, through a lower flange of the core 1 and back to the center of the core 1. Another known reactor has an iron core constructed by two or more sections. Between any two adjacent core sections an air gap is provided, and around such iron core a conductor is wound to form a coil. When the coil is energized, a magnetic flux $\phi$ flows through the iron core and through the air gaps among the core sections.

The known reactors of the above-mentioned types are provided with only several air gaps to determine the inductance. The air gaps are necessarily be so wide as a few milimeters. Due to the wide air gaps a humming noise is generated or a considerable leakage of magnetic flux inevitably takes place in the air gaps when the coil is energized, thereby causing noises. Furthermore, since the air gaps determine the inductance of the reactor, an error in the air gaps, if any, will provide an erroneous inductance value. To provide a desired, predetermined inductance, the air gaps should be machined with a high precision.

SUMMARY OF THE INVENTION

Accordingly an object of this invention is to provide a reactor the core of which has tiny gaps dispersed in it uniformly and which can reduce leakage flux to have a constant inductance over a wide frequency range.

A reactor according to this invention comprises an annular iron core constituting a closed magnetic path and a conductor wound on the iron core, the iron core being formed of particles of iron or an iron-based magnetic material each covered with an insulative oxide film containing 0.3 to 0.8% of oxygen by weight based on the particle.

BRIEF DESCRIPTION OF THE DRAWING

This invention can be more fully understood from the following detailed description when taken in conjunction with the accompanying drawings, in which.

DETAILED DESCRIPTION OF THE PREFERRED EMBODIMENTS

One embodiment of this invention will be explained by referring to FIGS. 2 and 3.

Figure 1:
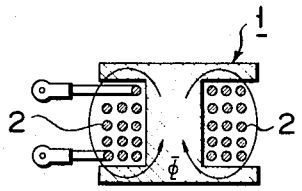
FIG. 1 PRIOR ART
FIG. 1 is a cross-sectional view of a conventional reactor.
Figure 2:
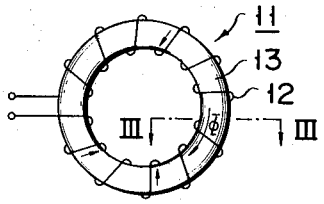
FIG. 2 is a front view of a reactor according to one embodiment of this invention.
Figure 3:
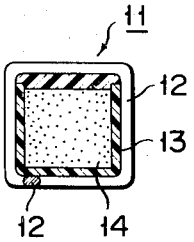
FIG. 3 is a cross-sectional view as taken along line III—III in FIG. 2.

FIG. 2 is a front view of a reactor. The reactor comprises an comrises an annular iron core 11 constituting a closed magnetic path and a coil 12, a conductor wound around the iron core 11. As shown in FIG. 3, the iron core 11 is formed of particles 14 of iron or an iron-based magnetic material filled in a casing 13 which is made of an insulating synthetic resin such as phenol and nylon. The particles 14 may be mixed with varnish, oil, fat or a synthetic resin such as epoxy resin and polyester resin.

The particles 14 are powder of iron such as electrolytic iron, carbonyl iron, reduced iron and atomized iron or powder of an iron-based magnetic material such as permalloy and silicon steel. They are oxidized to such extent that each is covered with an insulative oxide film containing 0.3 to 0.8% of oxygen by weight based on the particle. The insulative oxide film adheres to each particle 14 and can hardly be peeled off. The film assumes various colours according to its thickness, such as blue, gold and green.

The particles 14 are put together under pressure to form an annular core 11. They are thus in mutual contact and electrically insulated from one another, leaving gaps among them. The gaps are dispersed substantially uniform within the annular core thus formed. They are so small that when a magnetic flux flows through them a humming noise would not be generated or the magnetic flux would not leak. Thus noises are not caused when a magnetic flux flows through the gaps. In addition, since the particles 14 are mutually insulated, an eddy-current loss will not be increased even if the frequency of the current applied on the reactor is elevated. For the same reason the iron loss of the reactor is small. The reactor shown in FIGS. 2 and 3 therefore has good high frequency characteristics.

If the insulative oxide film of each particle 14 is made so thin as to contain less than 0.3% of oxygen by weight based on the particle, it will be broken when the particles 14 are packed into the casing 13. Once the insulative oxide films have been broken, the insulation among the particles 14 is damaged to reduce the inductance of the reactor with respect to a high frequency range. Thus an insulative oxide film whose oxygen content is less than 0.3% by weight based on the particle is undesirable. On the other hand, if the insulative oxide film of each particle 14 is made so thick as to contain more than 0.8% of oxygen by weight based on the particle, it will be brittle and be peeled off the particle when the particles 14 are packed into the casing 13. Also in this case the insulation among the particles 14 is damaged to reduce the inductance of the reactor with respect to a high frequency range. Accordingly an insulative oxide film whose oxygen content exceeds 0.8% by weight based on the particle is undesirable, too.

Electrolytic iron particles are relatively globular. Insulative oxide films formed on such globular particles cannot be easily broken. It suffices to form a relatively thin insulative oxide film on an electrolytic iron particle. Reduced iron particles, however, have a sponge-like structure and can thus be easily compressed. When they are packed into the casing 13, the insulative oxide films on them, if made insufficiently thin, will be broken. It is therefore preferred that reduced iron particles be oxidized to such extent that they are covered with a thick oxide film containing 0.6 to 0.8% of oxygen by weight based on the particle.

The particles 14 of iron or an iron-based magnetic material may be oxidized in various methods. They may be heated in the atmosphere, or they may be oxidized by chemical process.

The inductance of the reactor according to this invention is determined by the effective permeability of the iron core 11. This is because the effective permeability of the core 11 is proportional to the inductance of the reactor. The effective permeability of the core 11 is determined by the space which the gaps among the particles 14 provide all together. In other words, it is determined by the packing density of the particles 14 in the casing 13. The higher the packing density is (i.e. the smaller the space is), the higher the effective permeability becomes. However, the saturated current is in reverse proportion to the packing density. Thus when the packing density is low, the saturated current is large but the effective permeability is low. As a practical compromise, it is desired that the packing density of the particles 14 in the casing 13 be 2.0 to 6.5 g/cm$^3$.

Figure 4:
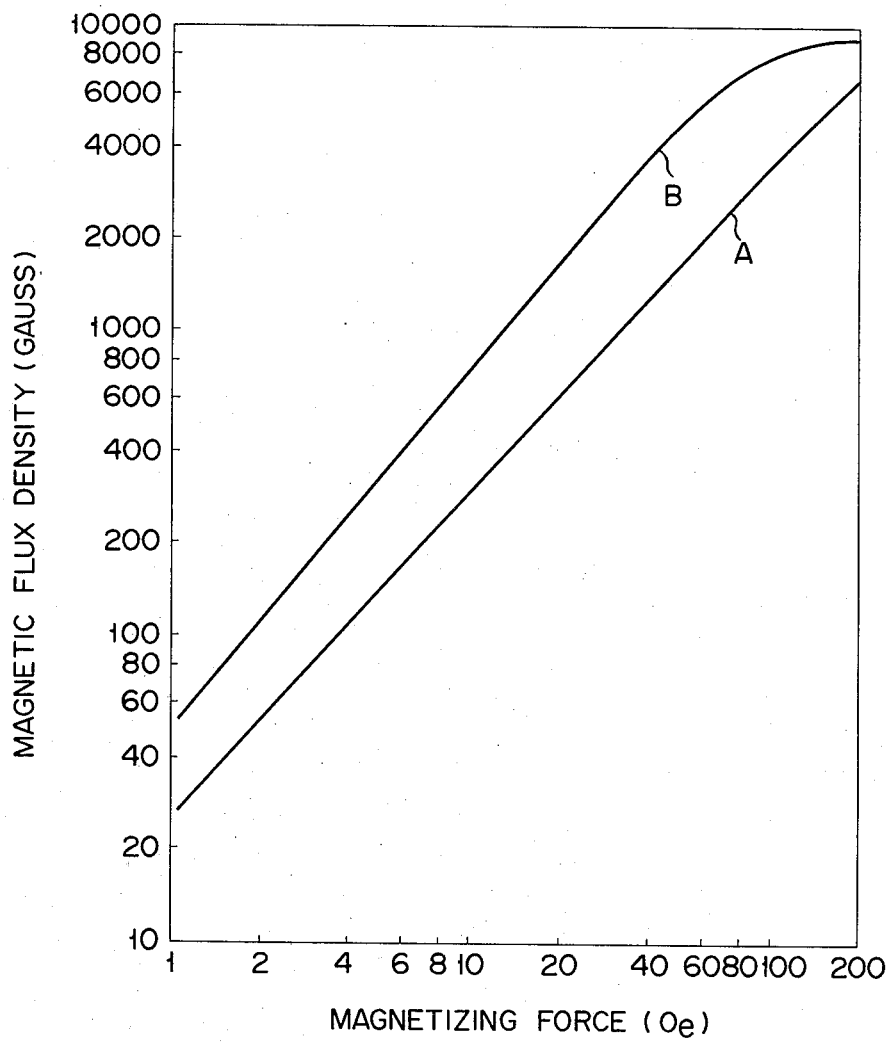
FIG. 4 is a graph showing the relationship between magnetizing force and magnetic flux density exhibited by iron cores according to this invention.

Reduced iron particles of 200 Tyler mesh size were oxidized until they were covered with an oxide film with an oxygen content of 0.5% by weight based on the particle. The oxidized iron particles were then packed together in packing density of 2.0 g/cm$^3$ to form an iron core and in packing density of 6.5 g/cm$^3$ to form another iron core. The first iron core showed such magnetizing force (oersted: $O_e$) and magnetic flux density (Gauss: G) as indicated by curve A in FIG. 4, and the second iron core showed such magnetizing force and magnetic flux density as indicated by curve B in FIG. 4. As FIG. 4 illustrates, the first iron core (packing density=2.0 g/cm$^3$) exhibited an effective permiability of about 30 (=magnetic flux density/magnetizing force), which is constant over the magnetizing force range of 1 to 200 $O_e$. In contrast, the second iron core (packing density=6.5 g/cm$^3$) exhibited a higher effective permeability of 70, but the magnetic flux density was saturated when the magnetizing force was 40 $O_e$ or more.

Reduced iron particles are desirable for two reasons. First, they are inexpensive. Secondly, they have a sponge-like structure and can thus be packed in a high density to help provide a reactor having a high inductance.

The size of the particles 14 influences the inductance in each frequency band. If the particles 14 are coarse, a high inductance can be taken at a low frequency band, but a high frequency loss is increased. The inductance at the high frequency band is therefore rapidly lowered when the frequency exceeds a certain value. Conversely if the particles 14 are fine, the inductance does not drop at the high frequency band but the overall inductance intends to decrease due to a decrease in effective permeability. In consequence, the particle size is selected according to a frequency band required. In practice, however, it will be sufficient if the inductance is constant over the frequency range of 0.1 to 700 KHz. In this case it is preferable to use an iron particles having a Tyler mesh size of −100 to +300, i.e. iron particles passable through a 100 Tyler mesh but not passable through a 300 Tyler mesh.

In the above-mentioned embodiment the iron core 11 is formed by filling particles 14 of iron or an iron-based magnetic material within the casing 13. This invention need not be limited to said embodiment. The particles 14 may be mixed with a synthetic resin acting as a bonding agent, whereby the mixture is so shaped to provide an iron core having a desired configuration, without using any casing. Or two or more core sections may be formed of mutually insulated particles and then may be put together to assemble an annular iron core.

The following examples of this invention and the following controls were manufactured:

EXAMPLE 1

Reduced iron particles having Tyler mesh size of 200 were heated and oxidized to such extent that each particle contained 0.3% of oxygen by weight. The oxidized particles were filled in an annular casing made of phenol resin having an outer diameter of 230 mm, an inner diameter of 160 mm and a rectangular cross-secional height of 30 mm. The particles were then packed in the casing at the packing density of 5.2 g/cm$^3$, thereby forming an iron core. Around the iron core a copper wire 0.8 mm thick was wound twenty times to form a coil, thus providing a reactor.

EXAMPLE 2

Reduced iron particles having Tyler mesh size of 200 were heated and oxidized until each particle contained 0.6% of oxygen by weight. The oxidized particles were packed in the same annular casing as used to form Example 1 at the packing density of 5.2 g/cm$^3$, thereby forming an iron core. Around the iron core a copper wire 0.8 mm thick was wound twenty times to form a coil, thus providing a reactor.

EXAMPLE 3

Reduced iron particles having Tyler mesh size of 200 were heated and oxidized until each particle contained 0.8% of oxygen by weight. The oxidized particles were packed in the same annular casing as used to form Example 1 at the packing density of 5.2 g/cm$^3$, thereby forming an iron core. Around the iron core a copper wire 0.8 mm thick was wound twenty times to form a coil, thus providing a reactor.

Control 1

Reduced iron particles having Tyler mesh size of 200 were heated and oxidized until each particle contained 0.2% of oxygen by weight. The oxidized particles were packed in the same casing as used to form Examples 1 to 3 at the same packing density of 5.2 g/cm$^3$, thereby forming an iron core. Around the iron core a copper wire 0.8 mm thick was wound twenty times to form a coil, thus providing a reactor.

Control 2

Reduced iron particles having Tyler mesh size of 200 were heated and oxidized until each particle contained 1.0% of oxygen by weight. The oxidized particles were packed in the same casing as used to form Examples 1-3 at the same packing density of 5.2 g/cm$^3$, thereby forming an iron core. Around the iron core a copper wire 0.8 mm thick was wound twenty times to form a coil, thus providing a reactor.

Figure 5:
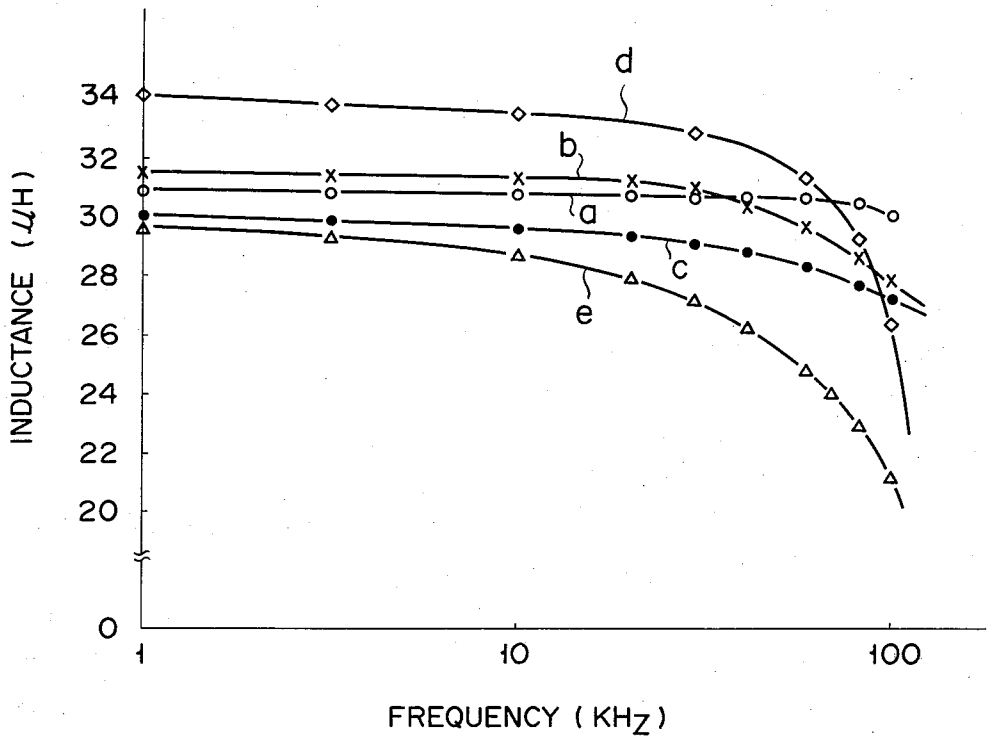
FIG. 5 is a graph showing the relationship between frequency and inductance of three examples according to this invention and the relationship between frequency and inductance of two controls, in case all the cores are formed of reduced iron particles packed in a specific density.

The inductance of Example 1 was found to vary according to the input frequency as indicated by curve a in FIG. 5. Examples 2 and 3 were found to have their inductance changed according to the input frequency as depicted by curves b and c in FIG. 5, respectively. Controls 1 and 2 were found to have their inductance varied according to the input frequency as shown by curves d and e in FIG. 5, respectively. As FIG. 5 clearly shows, Examples 1, 2 and 3 have their inductance reduced but a little at the high frequency band, whereas Controls 1 and 2 have their inductance reduced considerably at the high frequency band.

Further, two other Examples of this invention and two other Controls were manufactured as follows:

EXAMPLE 4

Reduced iron particles having Tyler mesh size of 200 were heated and oxidized until each particle contained 0.3% of oxygen by weight. The oxidized particles were then packed in the same casing as used to form Examples 1 to 3 and Controls 1 and 2 at the packing density of 4.5 g/cm$^3$, thereby forming an iron core. Around the iron core a copper wire 0.8 mm thick was wound twenty times to form a coil, thus providing a reactor.

EXAMPLE 5

Reduced iron particles having Tyler mesh size of 200 were heated and oxidized until each particle contained 0.8% of oxygen by weight. The oxidized particles were then packed in the same casing as used to manufacture examples 4 at the same packing density of 4.5 g/cm$^3$, thereby forming an iron core. Around the iron core a copper wire 0.8 mm thick was wound twenty times to form a coil, thus providing a reactor.

Control 3

Reduced iron particles having Tyler mesh size of 200 were heated and oxidized until each particle contained 0.2% of oxygen by weight. The oxidized particles were then packed in the same casing as used to manufacture Examples 4 and 5 at the same packing density of 4.5 g/cm$^3$, thereby forming an iron core. Around the iron core a copper wire 0.8 mm thick was wound twenty times to form a coil, thus providing a reactor.

Control 4

Reduced iron particles having Tyler mesh size of 200 were heated and oxidized until each particle contained 1.0% of oxygen by weight. The oxidized particles were then packed in the same casing as used to manufacture Examples 4 and 5 at the same packing density of 4.5 g/cm$^3$, thereby forming an iron core. Around the iron core a copper wire 0.8 mm thick was wound twenty times to form a coil, thereby providing a reactor.

Figure 6:
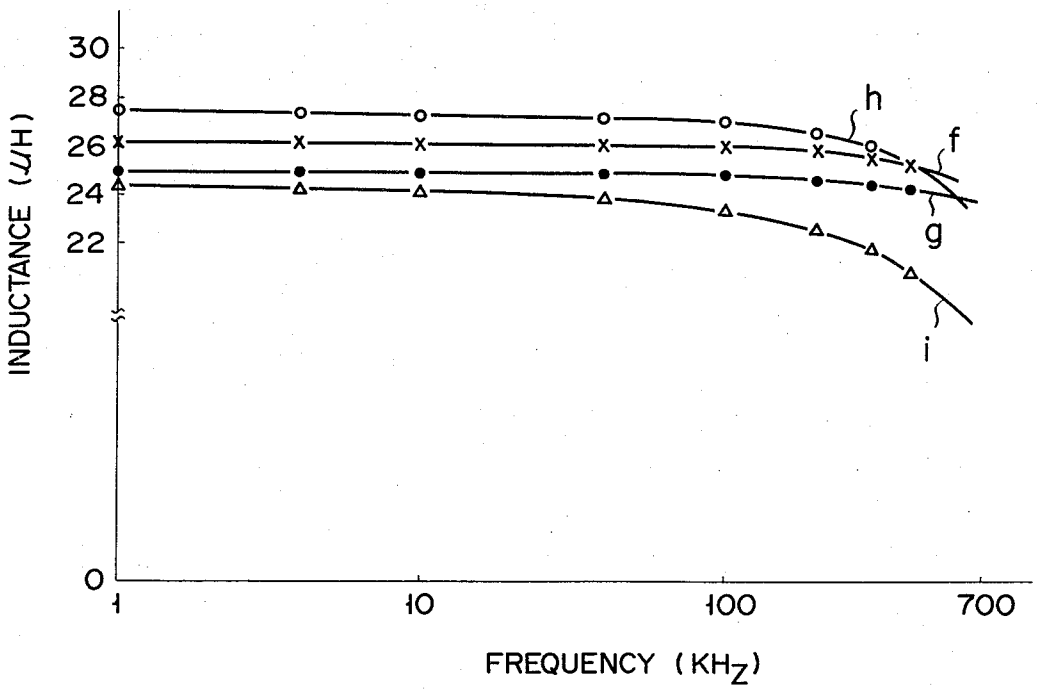
FIG. 6 is a graph showing the relationship between frequency and inductance of two examples according to this invention and the relationship between frequency and inductance of two controls, in case all the cores are formed of reduced iron particles packed in a lower density.

Examples 4 and 5 were found to have their inductance varied according to the input frequency as indicated by curves f and g in FIG. 6, respectively. By contrast, Controls 3 and 4 were found to have their inductance changed according to the input frequency as depicted by curves h and i in FIG. 6, respectively. FIG. 6, when compared with FIG. 5, clearly shows that the frequency characteristic of the reactor according to this invention will be improved if the packing density of the particles forming the iron core is lowered.

As mentioned above, the reactor according to this invention is free from generation of leakage flux or humming noise which would cause noises. In addition, it has a constant inductance which can remain accurate even at a high frequency band.

What we claim is:

1. A reactor comprising an annular iron core constituting a closed magnetic path and a conductor wound on the annular core, said iron core being formed of particles of iron or an iron-based magnetic material each covered with an insulative oxide film which contains 0.3 to 0.8% of oxygen by weight based on the particle.

2. A reactor according to claim 1, wherein said particles are packed in a density of 2.0 to 6.5 g/cm$^3$.

3. A reactor according to claim 2, wherein said particle having a Tyler mesh size of $-100$ to $+300$.

4. A reactor according to any one of the preceding claims, wherein said particles are reduced iron powder.

5. A reactor according to claim 1, wherein said oxide film is formed by heating said particles.

* * * * *